United States Patent [19]

Graham

[11] 4,308,604

[45] Dec. 29, 1981

[54] GLOBE CLOCK

[76] Inventor: James L. G. Graham, 42 Chepstow Rd., London W2., England

[21] Appl. No.: 153,347

[22] Filed: May 27, 1980

[51] Int. Cl.[3] ..... G04B 19/22

[52] U.S. Cl. ..... 368/23; 368/25; 368/26; 368/206

[58] Field of Search ..... 368/21–27, 368/206, 215

[56] References Cited

U.S. PATENT DOCUMENTS 1,078,409 11/1913 Bernhardt ..... 368/206
1,152,904 9/1915 Ramage ..... 368/23
2,223,605 12/1940 Dupler ..... 368/24
2,333,475 11/1943 Dupler ..... 368/23

*Primary Examiner*—Ulysses Weldon
*Attorney, Agent, or Firm*—Biebel, French & Nauman

[57] ABSTRACT

A clock for indicating the different times at different places in the world, comprises a globe and a dial ring rotatable in an annular groove formed around the inside of the globe at its equatorial region. The dial ring is rotated around the globe by a clock movement. A time scale on the dial ring is visible through a transparent zone of the equatorial region of the globe, and the simultaneous times at the different places in the world are indicated by reading the time scale in conjunction with index marks provided on the globe and identifying different places in the world.

6 Claims, 4 Drawing Figures

Fig.1
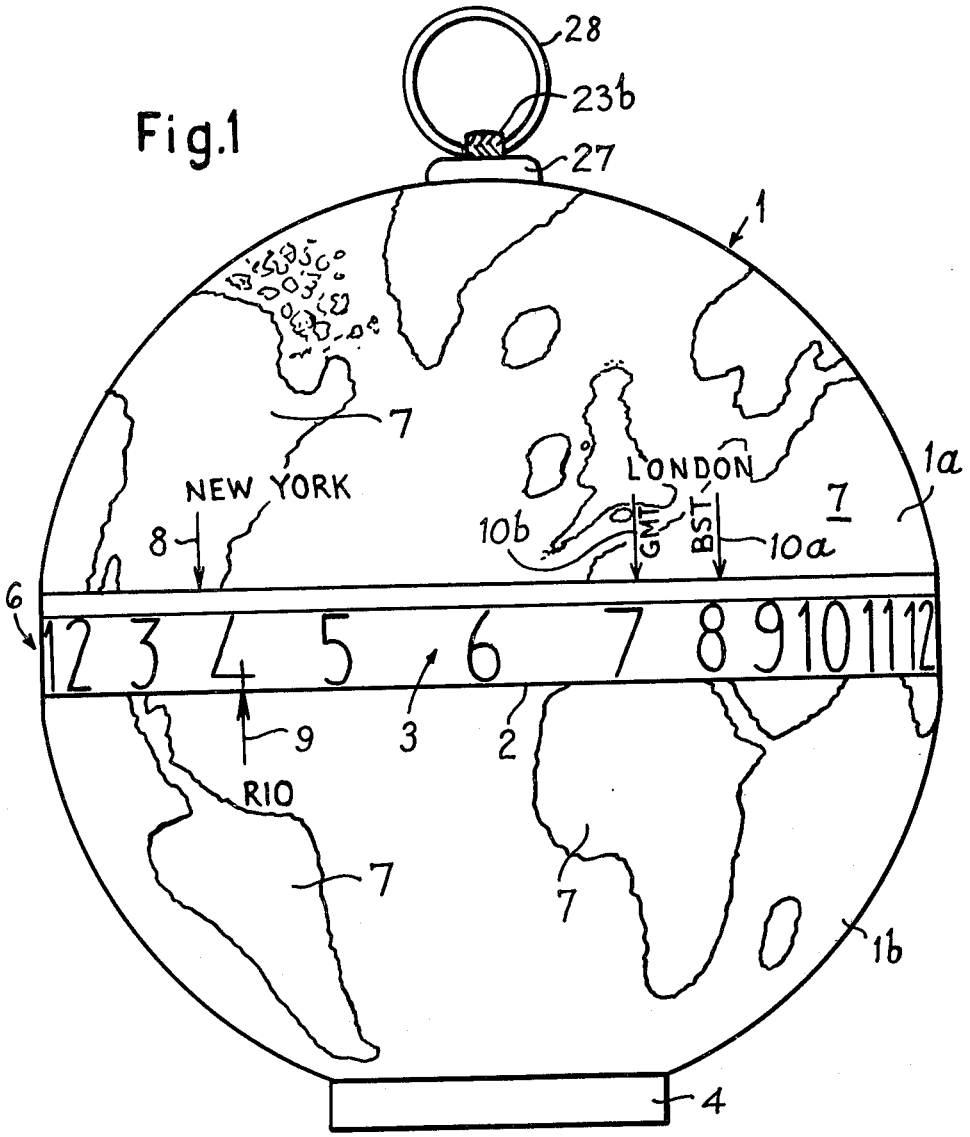
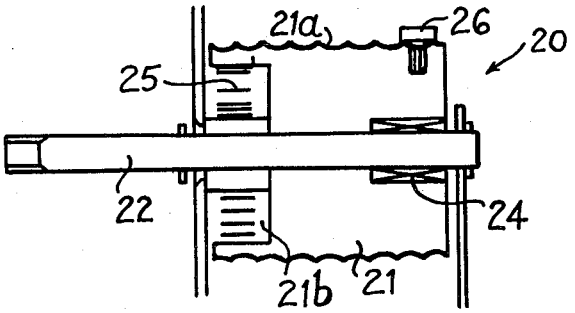
Fig.3

GLOBE CLOCK

FIELD OF THE INVENTION

The present invention relates to a clock and, more particularly, to a clock which indicates the times at different geographical locations.

BRIEF SUMMARY OF THE INVENTION

The present invention consists in a clock comprising a body part and a dial part rotatable relatively to one another, the dial part bearing a time scale representing a twenty four hour period and the body part bearing index marks which in conjunction with the time scale indicate the different times at different geographical locations in the world.

The body part may be hollow and is preferably in the form of a hollow globe, and the dial part may be rotatably mounted on the body part. The hollow body part may have an annular groove in which a ring forming the dial part is mounted and rotates about the body part. In the case where the body part is a hollow globe, the annular groove may be provided around the inside of the globe at and adjacent the equatorial zone of the globe, with the equatorial zone of the globe being transparent to permit viewing of the time scale on the ring through the globe.

The outside of the globe may be decorated with embossed regions having the outline of the various continents of the world. The index marks may represent principal cities throughout the world and be accompanied by the respective names of the cities in coloured lettering, for example in white, gold or silver.

In order readily to distinguish the 12 hour anti-meridian period from the 12 hour post-meridian period the dial part may be divided into two twelve-hour regions which are in different colours. For example, the anti-meridian period may be gold coloured whilst the post-meridian period may be silver coloured.

In one embodiment, the clock movement is located within a hollow body part and includes a wind-up device for the clock movement, comprising a rotatable member mounted on a shaft, means for rotating the rotatable member in one direction, clutch means which permit the shaft to rotate with the rotatable member when the latter is rotated in said one direction, and spring means for returning the rotatable member to its initial position, whereby repeated rotation of the rotatable member winds up the clock movement.

BRIEF DESCRIPTION OF THE DRAWINGS

In order that the invention may be more readily understood, reference will now be made to the accompanying drawings in which:

FIG. 1 is an elevational view of one embodiment of the invention,

FIG. 3 is a fragmentary cross-sectional view illustrating the wind-up device of the clock.

DETAILED DESCRIPTION OF THE DRAWINGS

Figure 2:
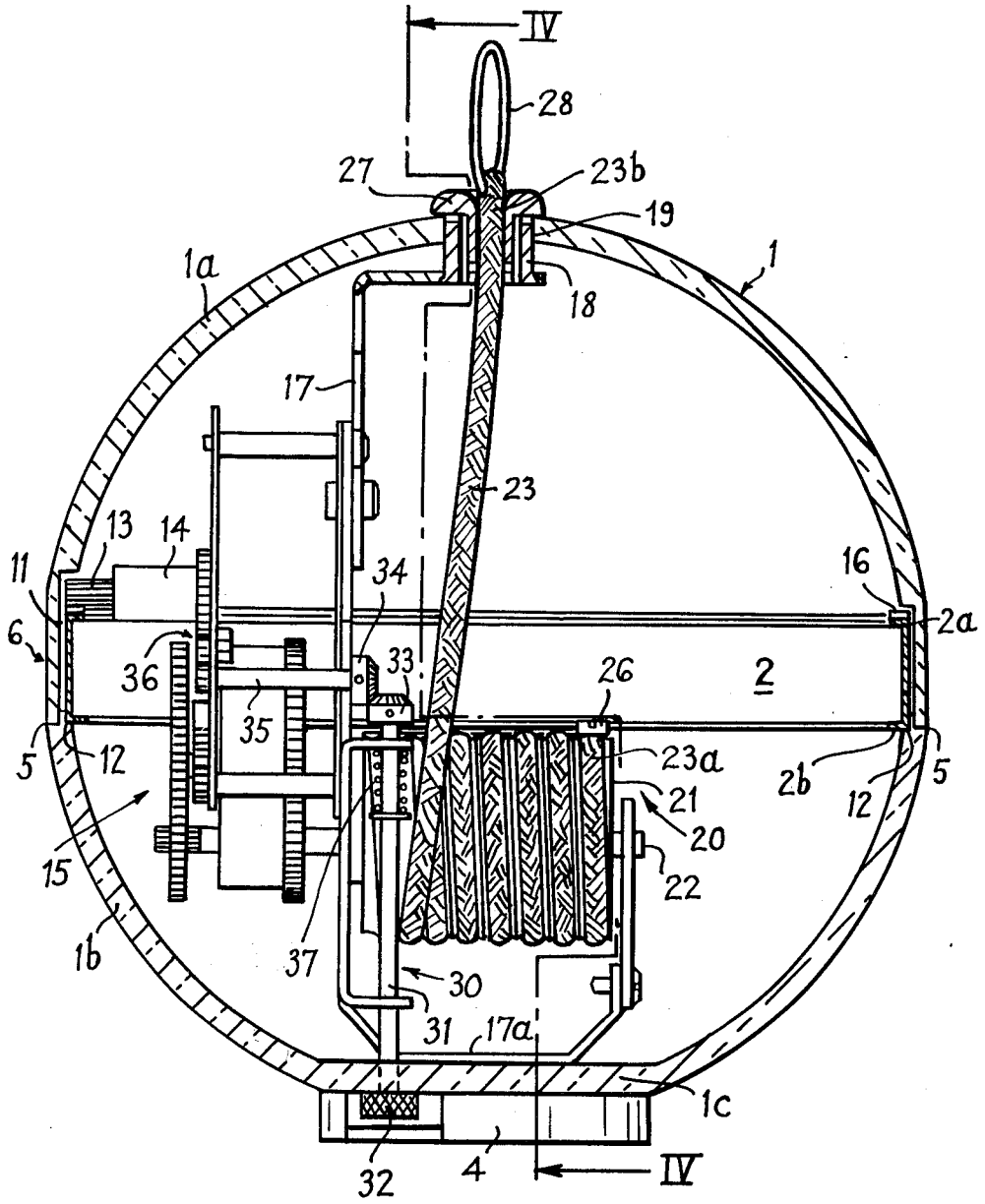
FIG. 2 is a vertical cross-sectional view through the clock.
Figure 4:
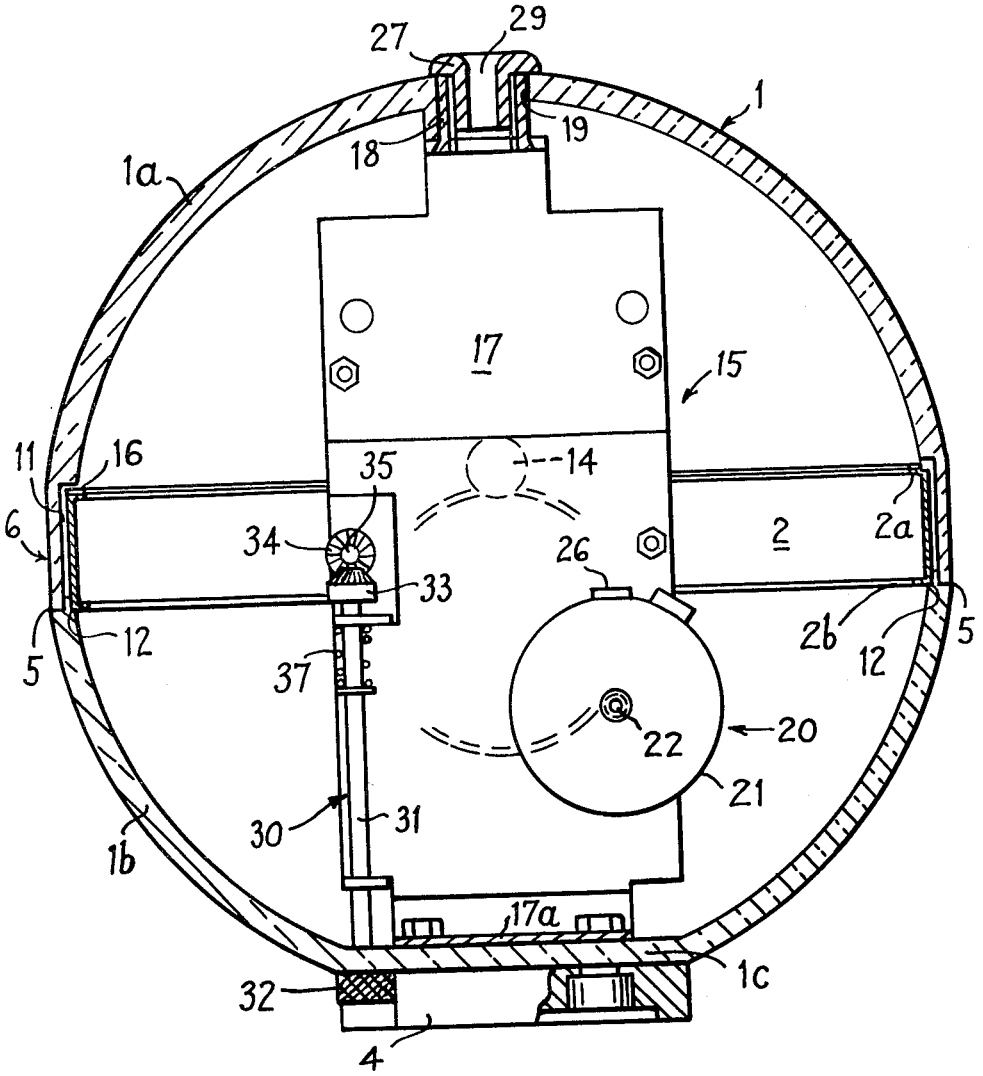
FIG. 4 is a cross-sectional view taken on the line IV—IV of FIG. 2, with the wind-up cord omitted.

Referring to the drawings, the clock comprises a hollow body part in the form of a globe 1, made for example of moulded plastics material, and a dial part in the form of a cylindrical ring 2 which bears a time scale 3 and rotates within the globe. The globe 1 comprises upper and lower parts 1*a*, 1*b*, the lower part 1*b* having a flat bottom 1*c* which is mounted on a base member 4. The two globe parts 1*a*, 1*b* meet at 5 adjacent a transparent equatorial zone 6 provided by the upper globe part 1*a*. On opposite sides of the equatorial zone 6 the globe parts 1*a*, 1*b* are opaque or semi-opaque, for example black and semi-opaque, and have regions 7 embossed in the outlines of the continents of the world. Index marks in the form of arrows 8, 9, 10*a*, 10*b* designated with the names of different principal cities of the world are provided on the globe 1 on opposite sides of and adjacent the transparent equatorial zone 6. The spacings between the arrows around the globe 1 are proportional to the differences in times between the designated cities.

The globe 1 has an internal annular groove 11 at and adjacent the equatorial zone 6 which extends around the inside of the globe. The dial ring 2, which has upper and lower annular stiffening ribs 2*a*, 2*b*, is mounted in the annular groove 11, with the lower rib 2*b* bearing on an annular ledge or shoulder 12 provided by the lower globe part 1*b*. The time scale 3 on the dial ring 2 may be divided into two twelve-hour regions or, alternatively, may provide a single twenty hour region extending around the whole of the dial ring.

A pinion 13 driven by an output shaft 14 from the clock movement 15 meshes with a ring of teeth 16 provided on the upper stiffening rib 2*a* of the dial ring 2 to rotate the dial ring once every twenty-four hours.

The transparent equatorial zone 6 of the globe 1 permits the time scale 3 to be viewed through the globe and read in conjunction with the arrows 8, 9, 10*a*, 10*b* to determine the relative different times in the different represented principal cities. As can be seen from FIG. 1 the arrows 10*a*, 10*b* take into account the time changes which occur due to the change-overs between British Summer Time (B.S.T.) and Greenwich Mean Time (G.M.T.).

The globe 1 houses the clock movement 15 which is mounted on a frame 17. The lower end 17*a* of the frame 17 is secured to the flat bottom 1*c* of the globe 1 and the base member 4. The upper end of the frame 17 terminates in an eyelet 18 which is located in an aperture 19 through the top of the globe 1.

The clock movement 15, for example an eight-day clock movement, includes a wind-up device 20 which comprises a rotatable drum 21 mounted on a shaft 22, a cord 23, for example a nylon cord, for rotating the drum 21 in one direction, a roller clutch 24 about the shaft 22, for example a torrington roller clutch which permits the shaft 22 to rotate with the drum 21, when the latter is rotated by the cord 23 in said one direction, and a spiral torsion spring 25 for returning the drum 21 to its initial position and rewinding the cord 23 onto the drum 21. When the drum 21 is rotated by the cord 23 it winds up a main spring (not shown) in the clock movement for driving the pinion 13.

The periphery of the drum 21 is provided with a helical groove 21*a* for guiding the cord 23 such that the cord is wound onto and around the drum in a helical fashion. One end 23*a* of the cord 23 is fixed by a securing means 26, such as a screw, to the drum 21 at one end of the helical groove whilst the other end 23*b* of the cord 23 extends out of the globe 1 through a bush or grommet 27 located in the eyelet 18 at the top of the globe 1. The end 23*b* of the cord is secured to a pull-ring 28 of larger diameter than the opening 29 in the bush or grommet 27 to prevent the cord end falling into the globe and becoming inaccessible.

The spring 25 is located about the shaft 22 within a recess 21*b* at one end of the drum. One end of the spring 25 is fixed to the drum 21 whilst its opposite end is fixed to a relatively stationary part of the clock (not shown). The spring 25 biases the drum 21 to a position wherein the cord 23 is helically wound around the drum.

When the cord is pulled repeatedly by the pull-ring 28 the drum 21 is rotated whereupon the torrington roller clutch 24 about the shaft 22 engages the shaft and causes it to rotate repeatedly with the drum and wind up the main-spring (not shown) of the clock movement 20 for driving the pinion 13. When the pulling force on the cord 23 is released the shaft 22 becomes disengaged from the drum 21 whereupon rotation of the shaft ceases and the torsion spring 25 returns the drum 21 to its initial position with the cord 23 wound around the helical groove 21*a*.

The clock also includes a control member 30 for manually adjusting the rotational position of the dial ring 2 so that, if necessary, the times indicated with respect to the geographical location markings on the globe can be altered or corrected. This control member 30 comprises a vertical rod 31 whose lower end extends through the bottom 1*c* of the globe 1 and is provided with a knob 32 whilst the upper end of the rod is provided with a bevel gear 33. The bevel gear 33 meshes with a bevel gear 34 mounted at the end of a rotatable shaft 35 which when turned causes rotation of the pinion 13 via a gear train 36. The control member 30 is biased downwardly by a compression spring 37, to a position where the bevel gears 33, 34 are out of mesh. Upward movement of the control member 30 against the action of the spring 37 causes the bevel gears 33, 34 to mesh and turning of the control knob 32 then effects rotation of the output shaft 14 and thus the pinion 13.

Whilst a particular embodiment of the invention has been described above, it will be appreciated that various modifications may be made without departing from the scope of the invention. For example, the body part may be generally in the form of a cylinder. Alternatively, the dial part may be in the form of a disc which is rotatable within an aperture or recess in the body part with the time scale provided around the periphery of the disc and the markings representing the different geographical locations provided on a wall of the body part adjacent the periphery of the rotatable disc. Instead of having a wind-up clock movement, the clock may be electrically driven, for example by a battery.

I claim:

1. A clock comprising:

(a) a stationary body part in the form of a hollow globe having a transparent, annular equatorial zone and an annular groove provided around the interior surface thereof at and adjacent the equatorial zone of said globe, (b) a dial part in the form of a ring bearing a time scale on the outer peripheral surface thereof representing a twenty-four hour period, said ring being mounted in said annular groove so as to be rotatable about said globe with said time scale being visible through said transparent equatorial zone, said globe bearing the outline of continents and countries of the world and having index marks adjacent at least one of the peripheral side edges of said ring for indicating different relative times at different geographical locations in the world and cooperating with said time scale to indicate them, (c) clock movement means mounted within said globe, and (d) gear means coupling said clock movement means to said ring to rotate said ring within said annular groove, whereby said index marks on said globe in conjunction with said time scale on said ring simultaneously indicate the different times at said different geographical locations.

2. A clock as claimed in claim 1, wherein said clock movement means comprises a mechanical mechanism located within said hollow globe, and includes a wind-up device for the clock comprising a shaft, a rotatable member mounted on said shaft, means for rotating the rotatable member in one direction from an initial position, clutch means which is associated with said shaft and said rotatable member and which is adapted and arranged to rotate said shaft with said rotatable member when the latter is rotated in said one direction, and spring means associated with said rotatable member for returning the latter to its said initial position, whereby rotation of said rotatable member winds-up the clock movement.

3. A clock as claimed in claim 2, wherein said clutch means is a roller clutch, and the spring means comprises a torsion spring, one end of said torsion ring being fixed to said rotatable member and the opposite end of said torsion spring being fixed to a relatively stationary part of the clock.

4. A clock as claimed in claim 2, wherein said means for rotating said rotatable member comprises a cord which is wound about said rotatable member, said hollow globe has an aperture therein, and one end of said cord is attached to the rotatable member whilst the other end of said cord extends through the aperture in said globe to enable the cord or string to be pulled against the biasing action of said spring means to effect rotation of said rotatable member in said one direction.

5. A clock as claimed in claim 4, wherein said rotatable member is in the form of a drum having a helical groove around its periphery for guiding the cord onto the drum.

6. A clock as claimed in claim 1, wherein (a) said dial part is in the form of a cylindrical ring, (b) a ring of gear teeth is disposed about the dial part, and (c) wind-up means is provided for said clock movement means comprising a drum connected to a wind-up shaft of said clock movement means and adapted sequentially to turn in opposite directions and intermittently turn said wind-up shaft in one direction to wind-up the clock movement, and a cord which extends through an aperture in the globe to the outside thereof and which is alternately pulled and allowed to rewind onto the drum to turn said wind-up shaft in said one direction.

* * * * *

UNITED STATES PATENT AND TRADEMARK OFFICE

CERTIFICATE OF CORRECTION

PATENT NO. : 4,308,604

DATED : December 29, 1981

INVENTOR(S) : James Leverton Gore Graham

It is certified that error appears in the above—identified patent and that said Letters Patent is hereby corrected as shown below:

Title, "GLOBE CLOCK" should be -- A GLOBE CLOCK --

Col. 4, line 7 "them" should be -- time --

Signed and Sealed this

*Thirteenth* Day of *April 1982*

[SEAL]

*Attest:*

GERALD J. MOSSINGHOFF

*Attesting Officer*

*Commissioner of Patents and Trademarks*